United States Patent [19]

Ranger

[11] Patent Number: 4,520,048

[45] Date of Patent: May 28, 1985

[54] METHOD AND APPARATUS FOR COATING PAPER AND THE LIKE

[75] Inventor: Alan E. Ranger, Kent, England

[73] Assignee: International Octrooi MaatschappiJ "Octropa" B.V., Netherlands

[21] Appl. No.: 571,278

[22] Filed: Jan. 16, 1984

[30] Foreign Application Priority Data

Jan. 17, 1983 [GB] United Kingdom ..... 8301189
Jan. 17, 1983 [GB] United Kingdom ..... 8301191

[51] Int. Cl.[3] ..... B05D 3/12; B05D 1/28; C23C 13/08; B05B 5/00

[52] U.S. Cl. ..... 427/350; 427/362; 427/366; 427/428; 118/50; 118/60; 118/244; 118/643

[58] Field of Search ..... 427/296, 350, 361, 362, 427/365, 366, 428; 118/50, 101, 106, 112, 118, 244, 60, 641-643

[56] References Cited

U.S. PATENT DOCUMENTS

| | | | |
|---|---|---|---|
| 2,252,204 | 8/1941 | Westbrook | 91/18 |
| 2,325,798 | 8/1943 | Porter | 117/68 |
| 2,934,467 | 4/1960 | Bergstein | 154/97.5 |
| 3,110,612 | 11/1967 | Gottwald et al. | 117/64 |
| 3,330,688 | 7/1967 | Halsey et al. | 117/64 |
| 3,600,215 | 8/1971 | Mervine | 427/362 |
| 4,287,280 | 9/1981 | Swift | 427/350 X |
| 4,396,390 | 8/1983 | Hendrix et al. | 427/350 X |

FOREIGN PATENT DOCUMENTS

| | | |
|---|---|---|
| 940704 | 10/1963 | United Kingdom . |
| 1143660 | 2/1969 | United Kingdom . |
| 1197856 | 7/1970 | United Kingdom . |
| 1556805 | 11/1979 | United Kingdom . |

*Primary Examiner*—Michael R. Lusignan
*Attorney, Agent, or Firm*—Cushman, Darby & Cushman

[57] ABSTRACT

Paper, paperboard or like permeable board is coated with a coating material and aqueous carrier liquid metered over the face thereof and a partial vacuum applied to the opposite surface as the coating is dried by heating. The vacuum improves the surface smoothness of the coating. The coating can be contacted with a casting surface and dried at a faster rate than if no vacuum were applied.

16 Claims, 5 Drawing Figures

METHOD AND APPARATUS FOR COATING PAPER AND THE LIKE

This invention relates to the coating of substrates such as paper and paperboard and similar permeable materials, hereinafter referred to as board, with a coating material applied to the board in an aqueous carrier liquid to improve the smoothness and other properties of the board.

For example, coating of paperboard with a pigment such as clay, titanium dioxide, or calcium carbonate, is commonly employed to improve the appearance and performance of paperboard. Pigment coating can improve the surface smoothness, gloss, brightness, whiteness, surface strength and uniformity of appearance as well as varnishability and printability of paperboard. Pigment coatings are generally applied and metered over the surface to be coated by a blade, bar, air knife or the like and then dried by the application of heat. The quality of the finished coating depends upon the board being coated, the coating formulation, the coater itself and the drying conditions.

It has been proposed in U.S. Pat. No. 2,186,957 that a coating material is applied to an embossed or rough textured paper as a relatively viscous solution and simultaneously therewith, or immediately thereafter, subjecting the rear of the sheet to reduced pressure or vacuum to remove air bubbles from between the newly deposited coating and the paper and draw a certain amount of the coating solution to a sufficient depth into the pores of the sheet to ensure good penetration and adhesion of the coating to the sheet surface, the coating following uniformly the surface variations of the paper to enhance the appearance without impairing the decorative effect of the embossed paper. The coating compositions employed in this process are solutions of cellulose derivatives.

In contrast to this teaching it is generally accepted that when applying a coating material as an aqueous suspension the penetration of water into the paperboard should be minimised as much as possible. After application of the coating material and before metering the drainage of water should be minimised to avoid metering difficulties. It is desirable to apply a suspension of coating material with the highest possible solids content in order to minimise the amount of water to be removed by drying and hence minimise the ever increasing energy costs of the drying process. Water penetration into the board between application and metering increases the solids content of the suspension to be metered and hence the possibility of metering difficulties thus limiting the solids content of the applied suspension. Furthermore it has also been considered necessary to minimise water penetration into the board after metering since it was considered that additives such as binder contained in the water would be carried out of the coating and into the board leading to a mechanical weakening of the surface of the coating.

Highly glossy smooth coated board materials are demanded for certain high quality applications where the appeal of the high gloss is required and the smoothness has not only aesthetic appeal but practical utility in enabling high quality printing to be achieved. For such applications a cast coated board is smoother than even top quality board coated by other coating techniques and has gloss values in excess of those normally achieved by varnishing such coated board.

Methods for cast coating of board materials hitherto proposed have only been capable of operating at relatively low speeds of about 30 to 70 meters per minute due to the time necessary to dry the coating. This slow rate of production inevitably results in a relatively high cost of the board compared with other coating processes running at up to 1000 meters per minute or more. The lengthy drying times arise because the coated surface of board is in contact with the casting surface which prevents vapour escaping directly from the coating as it is dried. The vapour must necessarily escape through the thickness of the board which creates a vapour pressure drop through the board from the coated surface to the uncoated surface depending upon the rate of heating and the permeability of the board. This limits the rate at which heat can be applied to the coating since the vapour pressure at the casting surface must not exceed the pressure maintaining the board in contact with the casting surface otherwise the casting effect will be lost. Similarly excessive vapour pressure between the coating and the board, or within the board, will cause defects in the finished material.

According to the present invention there is provided a method of smooth coating permeable board comprising applying to the face of the board a coating composition comprising a coating material and aqueous carrier liquid, metering the composition over the face of the board and subjecting the coated board to heat to remove the water and dry the coating, and reducing the pressure at the opposite back surface of the board relative to the pressure at the face of the board during the heating to remove the water. Surprisingly it has been found that any water penetration arising from the reduced pressure at the back of the board relative to the pressure at the face of the board does not give rise to any expected disadvantageous qualities in the appearance or performance of the coating. In fact the smoothness and gloss of the coating are improved and the porosity of the surface of the coating is reduced leading to improved varnishability whilst still being printable by lithographic printing techniques without any form of accelerated drying of the ink.

The amount of reduction of pressure at the back of the board relative to the pressure at the face of the board is dependent upon the porosity of the board and the coating composition. The lower the porosity of the board and the more viscous the coating composition the greater is the relative reduction of pressure necessary to achieve the same level of improvement in the properties of the finished coating.

The reduced pressure should preferably be applied until at least the outer surface of the coating achieves a consistency such that no further flowing of the outer surfaces occurs during any subsequent drying. When flow ceases to occur at the applied level of reduced pressure the cost of the process can be minimsed by removing the reduced pressure.

The coated board produced in this way can be calendered in accordance with normal clay coating practice to further improve the smoothness and gloss of the coating.

Whilst the coated board is heated the coated face can be brought into intimate contact with a casting surface under a contact pressure at the face of the board above atmospheric pressure, the coating being heated for at least part of the drying time at a rate which creates a vapour pressure drop through the thickness of the board greater than the difference between atmospheric pressure and the contact pressure, the pressure on the uncoated back of the board being reduced to below atmospheric pressure to maintain the vapour pressure at the interface between the coating and the casting surface below the contact pressure. The maximum rate of heat input to effect drying is determined by the maximum vapour pressure which may be safely generated at the interface between the casting surface and the coating. This maximum vapour pressure must be less than the contact pressure pressing the coating and the casting surface together. Reducing the pressure at the back of the board increases the permissible vapour pressure drop through the board thereby increasing the rate of vapour transmission through the board which can be obtained. Thus the rate of heat input into the coating can be increased to shorten the drying time. The vapour pressure at the interface between the coating and the casting surface is conveniently above atmospheric pressure to maximise the permissible heat input and hence the drying rate.

Conveniently the pressure at the back of the board is reduced relative to the pressure at the face of the board by applying a suction to the back of the board. This can be readily achieved by passing the board over a perforated plate, around a perforated drum connected to a source of vacuum or adjacent a vacuum box or boxes connected to a source of vacuum.

The relative reduction of pressure at the back of the board can be applied after metering and before the board is subjected to the drying heat.

The preferred coating material is clay and a binder and the coating composition conveniently comprises between 40% and 70% solids.

When the coated surface is dried in contact with a casting surface the majority of the carrier liquid is preferably vaporised whilst the pressure on the uncoated back of the board is below atmospheric pressure. The more drying carried out under such conditions the shorter the drying time and hence the greater is the possible throughput. A final drying can be effected after the pressure on the back of the board is returned to atmospheric.

The casting surface is preferably flexible and the coating heated whilst the board is held by the casting surface in contact with an inflexible permeable surface through which a partial vacuum can be applied to the back of the board. This ensures that the effect of the vacuum on the back of the board does not tend to pull the board away from the casting surface and adversely affect the quality of the cast surface. Once the coating has dried to become sufficiently permeable the vacuum will tend to draw not only the board but also the casting surface towards the permeable surface and hence supplement rather than reduce the contact pressure pressing the casting surface into contact with the coating.

A further layer of coating material and carrier liquid can be applied directly to the casting surface and dried at least to the point of immobility before pressing the coated surface of the board into intimate contact with the further layer on the casting surface to unite the two coatings together. The coating applied to the board forms a base coat which covers any undulations and irregularities in the surface of the board whilst the further layer applied to the casting surface can be relatively thinner. As the coatings dry they become firmly joined together, and to the board, and are removed from the casting surface in the usual way.

The further layer can be of the same material as the coating applied to the board but this method of cast coating is particularly advantageous if a dissimilar material is required, eg a coloured material to give a decorative effect. For example, if a coloured cast coating is to be provided on a board, the irregularities in the surface of the board result in a coating of varying thickness which in turn results in colour variations according to the thickness of the coating. In the present method the coloured further layer formed on the casting surface is of substantially constant thickness and hence without colour variations.

To prevent the carrier liquid of the further layer applied directly to the casting surface from being disrupted by rapid vaporisation of the carrier liquid the casting surface can be cooled to a temperature below the boiling point of the carrier liquid at atmospheric pressure before the further layer is applied. Alternatively the pressure on the uncoated back of the board can be reduced to a pressure to maintain the vapour pressure at the interface between the coating and the casting surface below atmospheric pressure and the coating heated to a temperature below the boiling point of the carrier liquid at atmospheric pressure to vaporise the carrier liquid and dry the coating. In this way the temperature of the casting surface can be maintained below the boiling point of the carrier liquid at atmospheric pressure.

The invention also provides apparatus for coating board comprising means for applying a coating material in an aqueous carrier liquid to one side of a board, a vacuum roll having an outer surface permeable to vaporised carrier liquid and adapted to be connected to a source of vacuum, a casting surface formed by an endless flexible band tensioned into contact with the permeable surface of the vacuum roll and means for guiding the board between the flexible band and the permeable surface with the coating in contact with the casting surface of the band, and heating means for heating the band to dry the coating whilst the board is in contact with the vacuum roll.

The heating means can conveniently comprise radiant heating means surrounding at least a portion of the periphery of the vacuum roll which is encompassed by the flexible band.

Applicator means can also be provided for applying a further layer of coating material and carrier liquid on the casting surface to enable the further coating to be applied to the board.

The invention will now be more particularly described with reference to the accompanying diagrammatic drawings in which.

Figure 1:
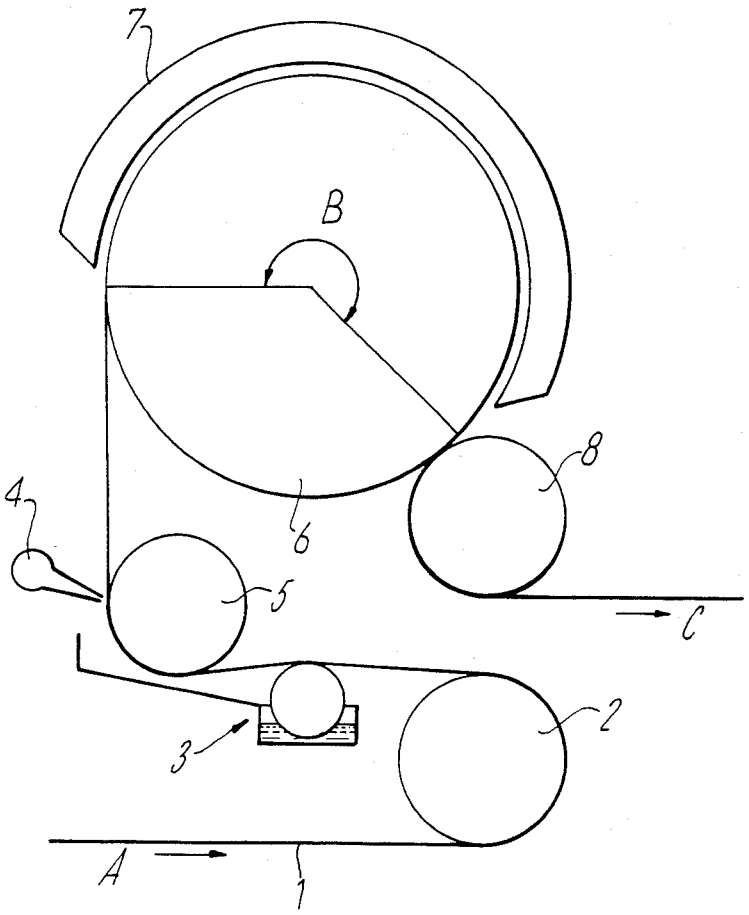
FIG. 1 is one form of apparatus for coating board.

Referring to FIG. 1 paper, paperboard or other like permeable board material 1 to be coated is supplied, eg from a reel (not shown) in the direction of arrow A and passes around roller 2 before passing an applicator 3 which applies over the width of the paperboard a quantity of a coating composition comprising a pigment and binder in an aqueous carrier liquid. Excess coating composition is removed from the board by suitable means such as an air knife 4 as the board passes around roller 5 and the board with the wet coating then passes around a drying drum 6 where the coating is heated by radiant heater 7. The drying drum is constructed so that that portion of the periphery of the drum within the arc B and which is contacted by the board is connected to a source of vacuum (not shown) so that the back surface of the board is subjected to a reduced pressure as the coating is dried. The board then passes around roller 8 and is removed from the drying drum in the direction of arrow C and if the coating and board is not completely dry can be subjected to further drying steps before being reeled or otherwise as desired. After being dried the coated board can be calendered before reeling in accordance with normal clay coating practice.

Figure 2:
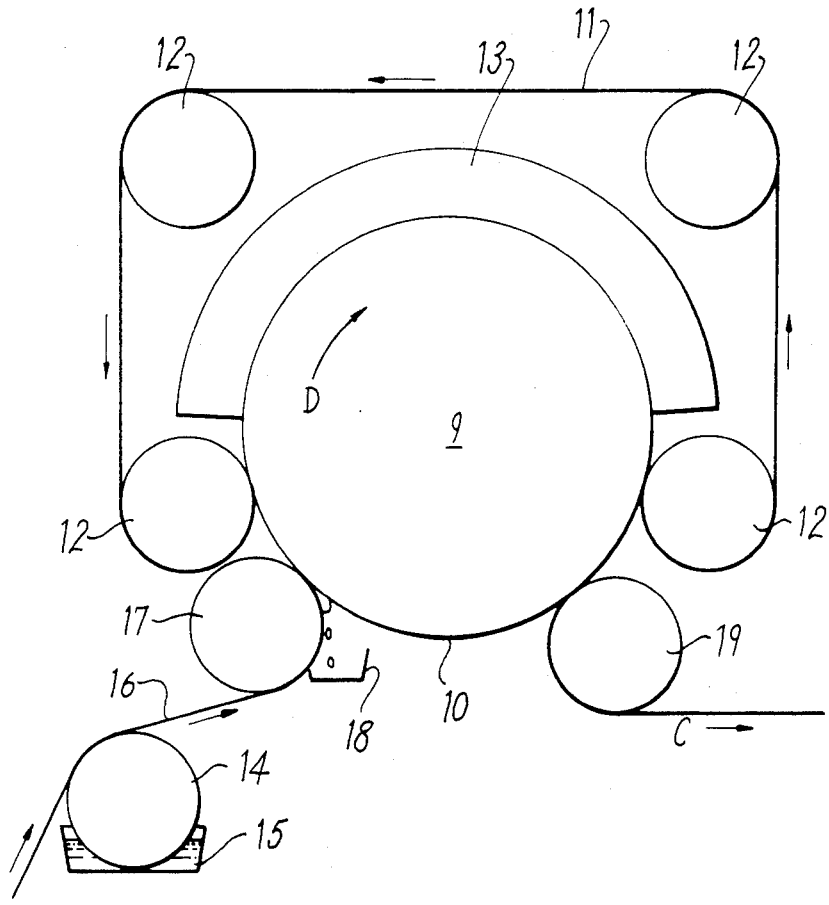
FIG. 2 is a form of apparatus for cast coating a board with a single layer of coating material.

Referring to FIG. 2 there is shown a casting cylinder 9, the outer surface 10 of which forms the casting surface and which is finished to a high degree of smoothness as is well known in the art. An endless permeable belt 11, eg an open mesh wire or plastics fabric, extends around guide rollers 12 and is tensioned thereby into contact with the casting surface. Surrounding the permeable belt is an array of vacuum boxes 13 connected to a source of vacuum (not shown).

An applicator 14 is provided to apply a coating composition 15 of coating material of pigment and binder in an aqueous carrier liquid to one side of a continuous web of board material 16, the coating composition being metered and excess coating composition being removed from the board as the web passes into the nip of a roll 17 with the casting surface, the excess material being collected in the trough 18.

Coated board material passes between the belt and the casting surface with the coating material in contact with the casting surface which is heated to heat the coating and vaporise the carrier liquid. The coating is urged into intimate contact with the casting surface under a contact pressure provided by the tension in the board material itself and the tension in the permeable belt. The belt is also preferably contacted by the vacuum boxes to help maintain the belt in position and to minimise loss of vacuum.

The coated board is separated from the casting cylinder after passing through the nip of a take-off roll 19 with the cylinder.

As the coating is heated the vaporised carrier liquid cannot escape through the casting surface 10 but must pass through the board and the permeable belt. There is therefore created a vapour pressure drop from the coating through the board and belt. If the vapour pressure at the interface between the coating and the casting surface is allowed to exceed the contact pressure, ie the vapour pressure drop through the board exceeds the difference between atmospheric pressure and the contact pressure, the intimate contact of the coating with the casting surface will be lost and the coating will not have the desired finish. Reducing the pressure at the back of the board relative to the contact pressure at the face of the board by applying a vacuum to the permeable belt reduces the vapour pressure at the aforesaid interface for a given rate of heat input. Thus vacuum can be applied to maintain the interface vapour pressure below the contact pressure and permit a rate of heat input such that the vapour pressure drop through the thickness of the board is greater than the difference between atmospheric pressure and the contact pressure. The vacuum at the back of the board thus increases the permitted rate of heat input and speeds the drying of the coating.

A disadvantage of the apparatus shown in FIG. 2 is that the vacuum reduces the contact pressure of the coating with the casting surface and hence the maximum permissible interface vapour pressure. Furthermore, contact of the vacuum box array with the permeable belt if maximum use is to be made of the vacuum leads to high frictional loadings.

Figure 3:
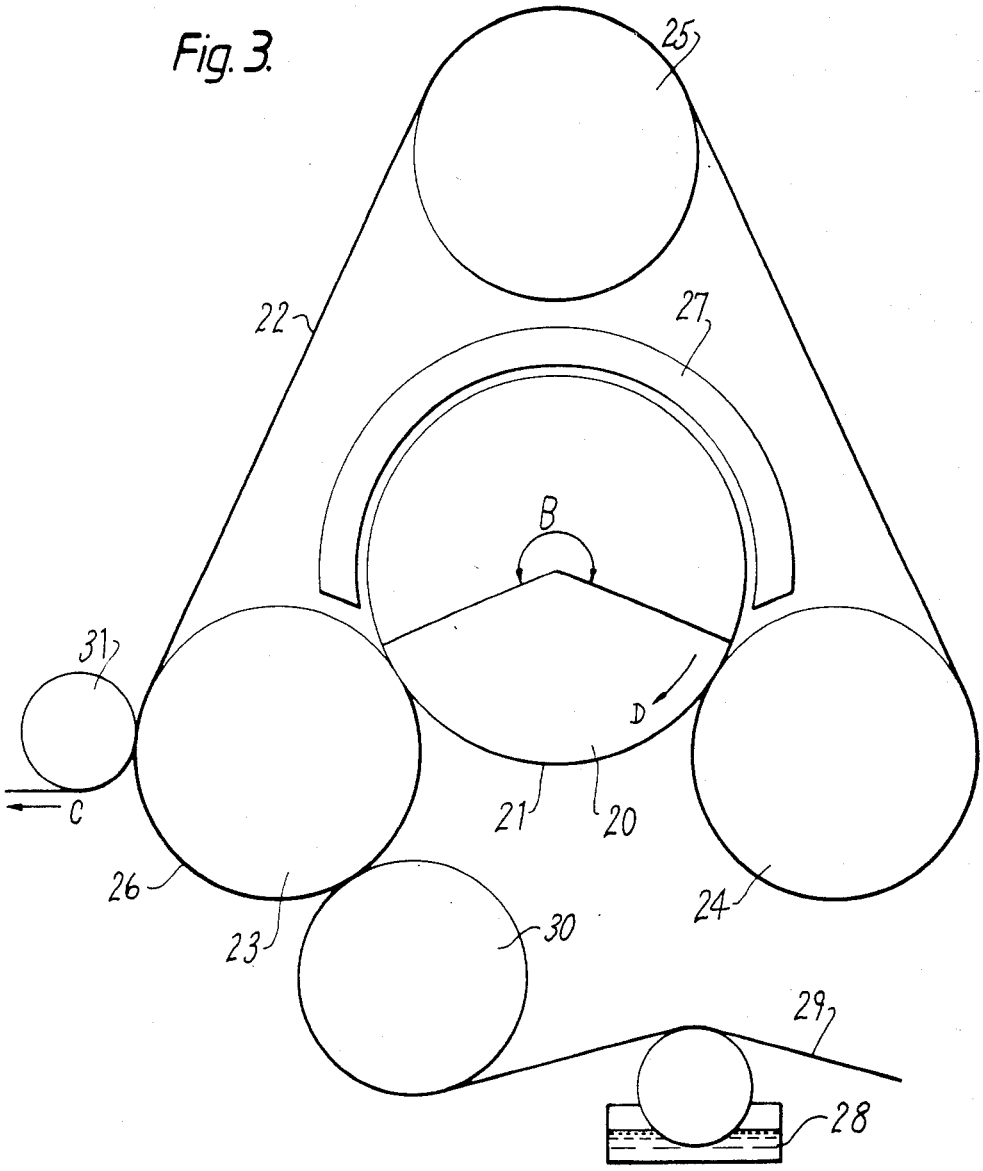
FIG. 3 is an alternative form of apparatus for cast coating a board with a single layer of coating material.

A preferred form of apparatus is shown in FIG. 3 comprising a suction roll 20, having an inflexible outer surface 21 which is permeable to vaporised carrier liquid. The suction roll is connected to a source of vacuum (not shown) and the roll is constructed so that that portion of its outer surface lying in the arc B is connected to the vacuum whilst the roll rotates in direction of arrow D.

A continuous flexible casting band 22 passes around three guide rolls 23, 24 and 25 and is tensioned to intimately contact the suction roll with that surface 26 of the band nearest the suction roll having a surface finish equivalent to that desired in the finished coating. An arcuate array of radiant heaters 27 surround a part of the periphery of the roll contacted by the casting band.

An applicator 28 applies a coating composition of coating material and aqueous carrier liquid to one side of a continuous web of board material 29, the web then passing around a roll 30 and into a nip between roll 30 and roll 23 where the composition is metered as it comes into contact with the casting surface 26 of the casting band 22. The board then passes into contact with the suction roll at the nip of the suction roll with the guide roll 23. The casting surface contacts the coating under a contact pressure dependent upon the tension in the casting band.

As the heat from the heaters passes through the casting band and heats the coating the carrier liquid is vaporised. The vapour cannot escape from the coating through the casting band but must necessarily pass through the board. The heating thus creates a vapour pressure drop through the thickness of the board from a maximum at the coating. The application of a partial vacuum to the permeable surface of the roll reduces the pressure at the back of the board and allows the rate of heat input to be such that the value of the vapour pressure drop through the thickness of the board is greater than the difference between the contact pressure and atmospheric pressure whilst still maintaining the maximum vapour pressure at the interface between the coating and the casting surface less than the contact pressure exerted by the tension in the casting band. Intimate contact between the coating and the casting surface is therefore maintained. As the coating dries and becomes permeable the vacuum will tend to draw both the board and the band into contact with the suction roll and supplement the contact pressure between the casting surface and the coating due to the tension in the casting band.

The coated board material passes around the rotating suction roll sandwiched between the permeable surface of the roll and the casting surface of the flexible band during which time the coating is at least partially dried and preferably the majority of the carrier liquid removed. The board may then remain in contact with the casting surface as the band passes around rolls 24 and 25 until the board is separated from the band after passing through the nip of take-off roll 31 and roll 23. Any carrier liquid remaining in the coating after the board leaves the suction roll is removed before the cast coated board, which leaves in the direction of arrow C, is wound on a reel (not shown). The cast coating thus formed has a surface finish corresponding to the surface finish of the casting surface.

Apparatus as shown in FIG. 3 can be used for coating paper, paperboard, cardboard and such similar permeable materials with any of the conventional pigment coating materials. Such coatings are commonly applied as an aqueous dispersion containing about 40%–70%, preferably 50–60% solids. The flexible casting band would generally be of stainless steel having a chromium plated casting surface.

Figure 4:
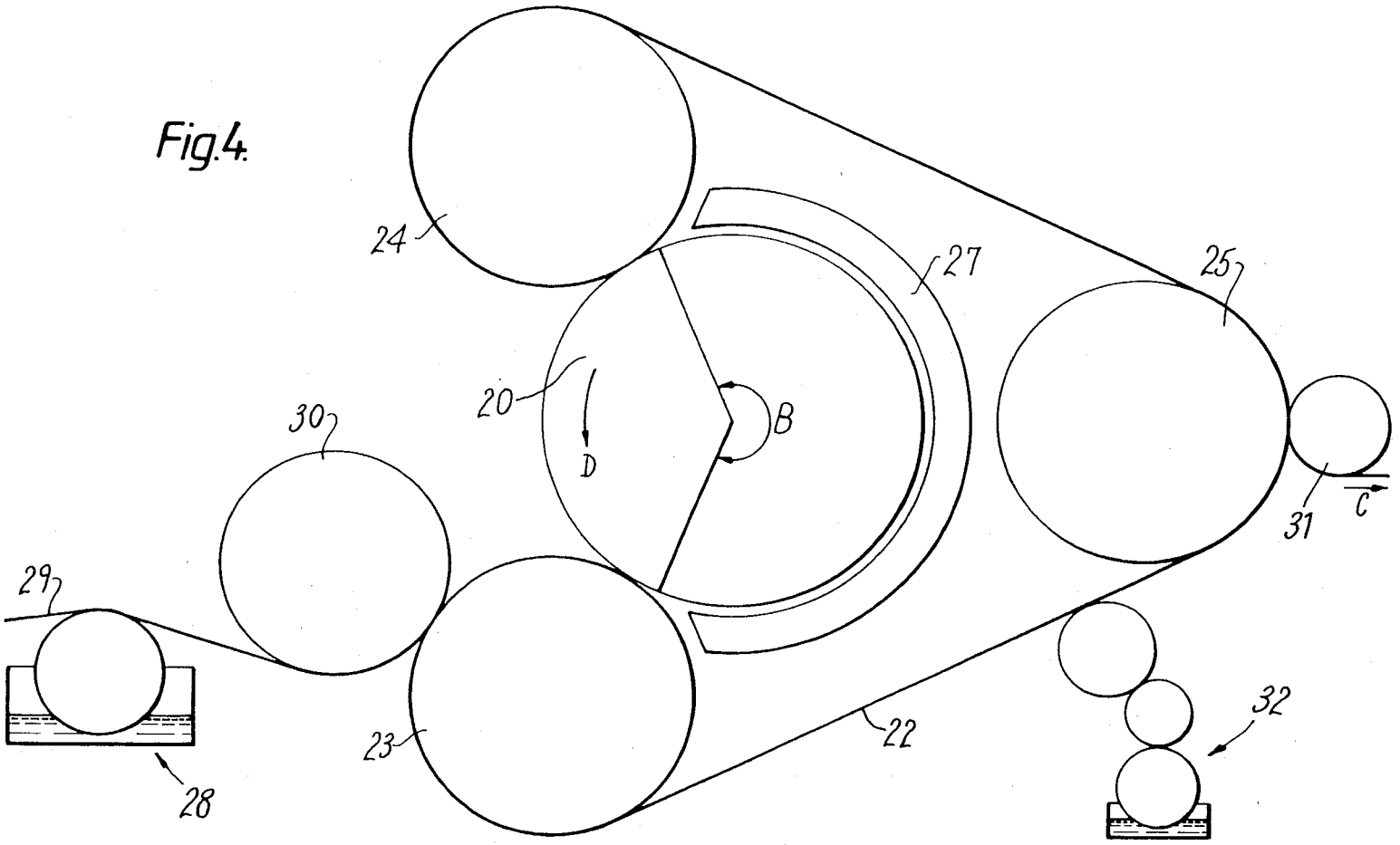
FIG. 4 is a further alternative form of apparatus for applying two layers of coating material.

Referring now to FIG. 4 there is shown an alternative apparatus in which an additional applicator 32 is provided for applying a further coating and a carrier liquid to the casting surface of the flexible band.

The apparatus is similar to that of FIG. 3 except that the arrangement has been turned through 90° so that the applicator 32 can be positioned to apply the further coating to the underside of the band. The take-off roll 31 has been repositioned adjacent guide roll 25 and the suction roll 20 rotates in direction of arrow D.

In operation of the apparatus of FIG. 4 the applicator 32 applies a layer of coating material and carrier liquid to the belt 22 which is warm after having previously been heated by the heaters 27. Before the coated casting surface reaches the nip between roll 23 and the roll 30 the coating on the casting surface has dried to the extent that it is immobile, ie the thickness of the coating will not be significantly altered in subsequent processing. At the nip between guide roll 23 and 30 the coating on the casting surface is united with the coating on the board 29. The board passes into the nip between the guide roll 23 and the suction roll 20 and around the roll beneath the heaters as before and leaves the band at the take-off roll 31, the two layers of coating now being firmly secured together so that the combined coating peels away from the casting surface with the board.

The coating formed on the casting surface is of substantially constant thickness, the coating applied to the board forming a base layer one side of which adapts to the irregularities of the surface of the board and the other side conforms to the coating on the casting surface. Thus when the further layer of coating applied to the casting surface is a coloured coating the finished cast coated board has a consistent appearance without any colour variations arising because of variations in thickness of the coloured layer.

It will be appreciated that the further coating material and carrier liquid is applied to the belt 22 when the belt is warm. The temperature of the belt should be lower than the boiling point of the carrier liquid at atmospheric pressure to ensure that the coating layer is not disrupted whilst on the belt by boiling of the carrier liquid. Hence if the temperature to which the belt has been heated is too high it should be cooled prior to the further coating layer being applied.

Alternatively the vacuum applied to the uncoated back of the board can be such that the vapour pressure at the interface between the casting surface and the coating is below atmospheric pressure thereby reducing the boiling point of the carrier liquid and hence the temperature to which the coating has to be heated to vaporise the carrier liquid. In this way the temperature of the belt can be maintained below the boiling temperature of the carrier liquid at atmospheric pressure.

The rate of removal of water vapour according to the present invention can be compared with that of conventional cast coating in which the board is pressed into contact with a casting surface formed by the periphery of a heated drum by the tension in the board itself.

The factors governing the rate of removal of vaporised carrier liquid, ie water vapour, are the permeability of the board, and the maximum vapour pressure that can be employed consistent with the coating and casting surface remaining in sufficiently intimate contact for the casting surface to be reproduced on the coating surface.

Figure 5:
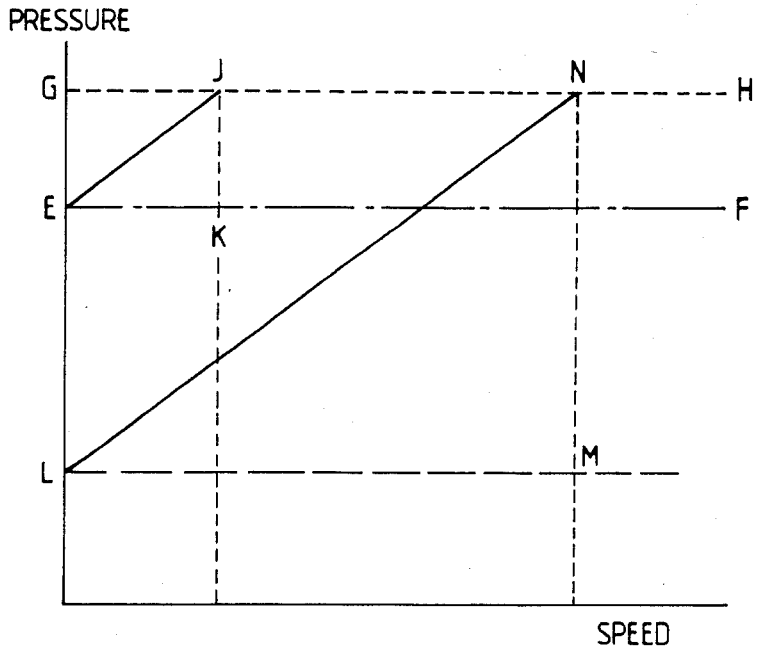
FIG. 5 shows diagrammatically the effect on the vapour pressure in the coating of applying a partial vacuum to the back of the board during cast coating.

Referring now to FIG. 5, there is shown diagrammatically the relationship between pressure shown on the ordinate and drying speed on the abscissa. The line EF represents normal atmospheric pressure. The line GH represents the pressure between the board and the casting surface, this pressure arising in the conventional cast coating process from the tension in the board and in the embodiment of FIGS. 3 and 4 of the present invention the pressure exerted by the tension in the flexible casting band on the board. If the vapour pressure at the interface between the coating and the casting surface exceeds the pressure indicated by the line GH then the necessary intimate contact therebetween and quality of the finished surface will be impaired.

In the process as hitherto proposed the pressure at the uncoated back of the substrate is atmospheric pressure and thus line EJ represents how the vapour pressure drop through the coated board increases as the speed, and hence heat input to dry the coating, increases. At the maximum speed the vapour pressure drop is JK and any attempt to increase the heat input to increase the speed beyond this point would lead to an excessive vapour pressure at the interface between the coating and casting surface.

In the present invention the level of vacuum applied to the back of the board is indicated by line LM and the line LN again represents how the vapour pressure drop through the board increases as the speed increases. At the same maximum vapour pressure N the maximum vapour pressure drop is NM giving a permissible speed considerably in excess of the conventional process which does not have vacuum applied at the back of the board.

EXAMPLE 1

To illustrate the method of coating as described with reference to FIG. 1 a coating material comprising 100 parts English coating clay and 20 parts styrene butadiene latex binder in the form of a coating composition comprising an aqueous suspension with a dispersing agent containing 60% solids was hand applied by draw down technique to a standard coating baseboard 455 microns thick having a weight of 275 g/m$^2$ to give a dry coat weight of 20 g/m$^2$. After this application the pressure at the back of the board was reduced to 25 kilo Pascals for a period of between 5 and 10 seconds and the coating was dried at 105° C.

The same coating was applied in an identical manner to the identical baseboard but without reducing the pressure at the back of the board. Samples of both boards were tested as follows.

1. The 75° gloss was measured with a Gardner Glossmeter.

2. After an application of 0.5 g/m$^2$ litho varnish had been allowed to dry the 75° gloss was measured again as in 1.

3. Smoothness was measured with a Parker Printsurf instrument with the sample loaded at two different pressures.

4. K & N ink absorption.

5. The set-off time for a varnish was determined by printing a strip of board on IGT apparatus with 1.5 microns litho ink followed by 1.5 microns litho varnish, wet on wet. The printed strip was rolled against the back of an identical board on IGT apparatus at a force of 40 kgf at various times after printing and the time when set-off became undetectable was noted in minutes.

6. Surface strength of the coating was determined on an IGT apparatus with the standard medium viscosity oil and the speed at which surface disruption was first evident was noted.

The average test results obtained over a number of experiments are given in the following Table.

| | Gloss | | | | | | Surface |
|---|---|---|---|---|---|---|---|
| | coated board | coated & varnished board | Smoothness 10 kgf/cm² | Smoothness 20 kgf/cm² | ink absorption | Set-off time | Disruption Speed mm/sec. |
| Coating without vacuum | 27.2 | 41.1 | 2.64 | 1.97 | 24.9 | 11 | 565 |
| Coating with vacuum | 31.4 | 53.3 | 2.42 | 1.78 | 24.3 | 6 | 625 |

Thus the process according to the invention was found to produce a coating having an improved gloss and smoothness as compared to the same process without the use of a reduced pressure at the back of the board.

The varnishability was improved as indicated by the improved gloss and this together with the improvements in set-off time and smoothness enhanced the printability whilst the ink absorption was not impaired.

Moreover it was found that there was little or no change in the strength of the coating.

Further improvement in the actual smoothness and gloss of both the coating applied according to the invention and that applied without reducing the pressure at the back of the board would be obtained on calendering the coated boards as is common practice in the art. Nevertheless the smoothness and gloss of calendered board coated according to the invention would again be proportionally better than that of the same board calendered after coating without the reduced pressure at the back.

EXAMPLE 2

This Example compares the method of the present invention as described with reference to FIG. 2 with a conventional cast coating process.

In cast coating eg as originally proposed in U.S. patent specification No. 1,719,166, when using a drum 2 meter in diameter the pressure of the web of board against the drum would be 0.015 atmospheres for a web tension of 1.5 KN per meter width. If the board is in contact with two thirds of the periphery of the drum a one meter width of board has a contact area of 4 m² which will pass 1000 liters/min of vapour if the board has a typical permeability of 250 mls/minute per 10 cm² at a pressure differential of 0.015 atmospheres.

An aqueous dispersion of a coating of 25 g/m² at 60% solids content means that 27 liters of water vapour have to be removed per square meter of board. The maximum speed of board 1 meter wide is therefore (1000/27) 37 m/min.

In the method of the present invention a vacuum of 0.1 atmospheres applied to the back of the board, having the same permeability and contact area with a 2 meter diameter suction roll will pass $(0.1/0.015)\times 1000$ liters/min over the area of contact, i.e. 6,670 liters/min which is equivalent to 247 meters/min of board 1 meter width having 27 liters of water vapour to be removed per square meter. This calculation for the method of the present invention ignores any additional vapour pressure difference allowed by the tension in the casting band.

Thus in the above example for a 2 meter diameter suction roll there is an increase in throughput as compared to the original process of cast coating from 30 to over 200 meters per minute. Furthermore the present invention allows the suction roll diameter to be reduced if the vacuum is increased and still maintain the same throughput. For example if the suction roll were 1 meter in diameter the board area in contact with the roll is halved and the amount of water vapour that will pass through the contact area at a given vapour pressure differential is halved. Thus if the vacuum is doubled to 0.2 atmospheres the throughput will remain the same. The method of the present invention therefore allows the use of a smaller and cheaper suction roll than the 2 or 3 meter diameter drum normally employed in the original cast coating process.

EXAMPLE 3

In this Example a board was coated using a pilot apparatus essentially as shown in FIG. 3.

The board was a grade widely used in the UK as a packaging board comprising mainly mechanical pulp with a bleached chemical top liner. The board was 400 microns thick having a weight of 245 g/m² and an air permeability of 180 mil/min as measured on a Bendtsen, ie using a sample 10 cm² at a pressure differential of 15 cm water gauge across the sample.

The coating composition was 100 parts of English coating clay and 30 parts polyvinyl acetate latex binder together with water and minor additives such as a dispersion agent to give a 60% solids mix.

The coating composition was applied at 37 g/m² and passed around a permeable drum with the coating contacted by the flexible casting surface. The pressure in the permeable drum was reduced below atmospheric to give a pressure at the back of the board of 35 kilo Pascals and the coating dried by heating from radiant heaters heating the band.

Drying was effected in 1.4 seconds which was equivalent to a throughput of 170 meters/min with a permeable drum 2 meters in diameter.

The coated board released well from the casting band and had a 75° gloss of 96 as measured with a Gardner Glossmeter.

EXAMPLE 4

In this Example board material was coated with a coating material as described in Example 3 but applied at 26 g/m$^2$.

A further layer of coating material was applied at 6 g/m$^2$ to the coating surface as described with reference to FIG. 4, this further layer comprising 100 parts bronze metallic powder made to a paste and 100 parts polyvinyl acetate latex binder.

The two layers of coating combined and released well from the casting surface. The further layer provided a top layer to the finished coating having a uniform bronze coloured appearance and a 75° gloss of 98 measured as before.

What is claimed is:

1. A method of smooth coating permeable board comprising the steps of:

(a) applying to the face of the board a layer of coating composition comprising a coating material and aqueous carrier liquid;

(b) metering the composition over the face of the board;

(c) heating the coated board along a heating path to at least partially remove the water and dry the coating; and (d) subjecting the opposite back surface of the board along the heating path to reduced pressure relative to the pressure at the face of the board simultaneously during the heating of the coated board according to step (c) to aid in the additional removal of water.

2. A method according to claim 1 wherein step (d) is practiced by removing the relative reduction in pressure at the back of the board when the surface of the coating achieves a consistency at which it is no longer flowable.

3. A method according to claim 1 wherein step (c) is practiced by (i) bringing the coated face of the board into intimate contact with a casting surface under a contact pressure at the face of the board above atmospheric pressure and (ii) heating the board to vaporise the carrier liquid and dry the coating while in contact with the casting surface, the coating being heated for at least part of the drying time at a rate which creates a vapour pressure drop through the thickness of the board greater than the difference between atmospheric pressure and the contact pressure, and wherein step (d) is practiced by reducing the pressure on the uncoated back of the board to below atmospheric pressure to maintain the vapour pressure at the interface between the coating and the casting surface below the contact pressure.

4. A method according to claim 3 in which the vapour pressure at the interface between the coating and the casting surface is above atmospheric pressure.

5. A method according to claim 3 in which the majority of carrier liquid is vaporised while the pressure on the uncoated back of the board is below atmospheric pressure.

6. A method according to claim 3 in which the casting surface is flexible and the coating is heated whilst the board is held by the casting surface in contact with an inflexible permeable surface.

7. A method according to claim 5 further comprising the steps of:

(e) applying a further layer of coating material and carrier liquid to the flexible casting surface;

(f) drying the further layer at least to the point of immobility; and (g) uniting the first-mentioned layer and further layer by pressing the first-mentioned layer coated surface of the board into intimate contact with the dried further layer coating on the casting surface.

8. A method according to claim 7 in which the further layer of coating material is dissimilar to the coating applied direct to the board.

9. A method according to claim 7 in which pressure on the uncoated back of the board is reduced to a pressure to maintain the vapour pressure at the interface between the coating and the casting surface below atmospheric pressure and the coating is heated to a temperature below the boiling point of the carrier liquid at atmospheric pressure to vaporise the carrier liquid and dry the coating.

10. A method according to claim 1 in which the pressure at the back of the board is reduced relative to the pressure at the face of the board by applying a suction to the back of the board.

11. A method according to claim 10 in which the relative reduction of pressure at the back of the board is applied after metering and before the board is subjected to the drying heat.

12. A method according to claim 1 in which the coating material is clay and a binder.

13. A method according to claim 12 in which the coating composition comprises between 40% and 70% solids.

14. Apparatus for coating a board comprising:

applicator means for applying a layer of a coating composition including a coating material and a carrier liquid to one side of a board;

means defining a casting surface heating means operatively associated with said casting surface for heating the casting surface to dry the coating while the coating is in contact with the casting surface along a drying path; and vacuum roll means having an outer surface permeable to vaporised carrier liquid and adapted to be connected to a source of vacuum, said vacuum roll means for subjecting a second side, opposite to said one side, of said board to reduced pressure relative to the pressure at said one side along said drying path to aid in the removal of water from said applied layer; wherein said casting surface defining means includes (a) an endless flexible band tensioned into contact with the permeable surface of the vacuum roll means along said drying path and (b) guiding means for guiding the board between the flexible band and the permeable surface such that the applied layer coating is in contact with the casting surface of the band along said path simultaneously with the heating of the band by said heating means to dry the coating.

15. Apparatus according to claim 14 in which the heating means comprises radiant heating means surrounding at least a portion of the periphery of the vacuum roll means coextensive with the flexible casting band along said heating path.

16. Apparatus according to claim 15 comprising second applicator means for applying a further layer of coating material and carrier liquid on the casting surface.

* * * * *